US006257463B1

(12) United States Patent
De Polo

(10) Patent No.: US 6,257,463 B1
(45) Date of Patent: Jul. 10, 2001

(54) ASEPTIC CLOSURE FOR CONTAINERS OF LIQUIDS

(75) Inventor: Giuliano De Polo, Conegliano (IT)

(73) Assignee: Acqua Minerale S. Benedetto S.p.A., Scorze' (IT)

( * ) Notice: Subject to any disclaimer, the term of this patent is extended or adjusted under 35 U.S.C. 154(b) by 0 days.

(21) Appl. No.: 09/580,267

(22) Filed: May 26, 2000

(30) Foreign Application Priority Data

Jun. 29, 1999 (IT) ..... PD99A0142

(51) Int. Cl.[7] ..... B67D 3/00
(52) U.S. Cl. ..... 222/525
(58) Field of Search ..... 222/525

(56) References Cited

U.S. PATENT DOCUMENTS 3,276,640 * 10/1966 Kessler ..... 222/525
3,439,842 * 4/1969 Stull ..... 222/525
3,738,545 6/1973 Roy .
4,826,055 * 5/1989 Stull ..... 222/525

FOREIGN PATENT DOCUMENTS 0 909 718 4/1999 (EP) .

* cited by examiner

*Primary Examiner*—Philippe Derakshani
(74) *Attorney, Agent, or Firm*—Guido Modiano; Albert Josif; Daniel O' Byrne

(57) ABSTRACT

An aseptic closure for containers of liquids comprising a main body provided with a threaded ring, which is designed to be associated with a neck of a container and from which there protrudes a tubular projection which is coupled to an upper closure. A step protrudes from the inside wall of the projection, proximate to the main body, and forms a passage hole which is controlled by a flow control element which is monolithic, by means of radial supporting bridges, with respect to the upper closure; the upper closure has a tubular structure and can slide axially along the projection from a lowered position, which closes the hole because the flow control element forms a seal against its wall, to a raised position for opening the hole for the passage of the liquid.

11 Claims, 3 Drawing Sheets

ASEPTIC CLOSURE FOR CONTAINERS OF LIQUIDS

BACKGROUND OF THE INVENTION

The present invention relates to an aseptic closure for containers of liquids, particularly beverages.

It is well-known that there is a strongly felt need to provide containers for beverages with aseptic closures which allow to remove part of the contents and then ensure adequate sealing upon re-closure.

This is the case, for example, of containers for sodium replenishment beverages, i.e., beverages rich in mineral salts, which are widely used and appreciated by people who practice sports and need to replace the substances lost with perspiration.

In particular, the user must not be forced to drink the beverage all at once; the closure, after being opened, must allow re-closure so that the beverage can be preserved and can be consumed over a short period of time, keeping its characteristics unchanged.

The containers are normally constituted by a bottle-shaped container which has a neck and an opening through which the beverage is automatically introduced during packaging; a closure is subsequently fixed in order to provide aseptic closure.

Currently, one type of these closures is constituted by a main body which is provided with a threaded ring and must be screwed onto the neck of the container; a tubular projection protrudes axially from the main body.

The projection is coupled to an upper closure which is also tubular and can slide externally along the projection.

The upper closure is shaped complementarily to the projection and is provided with a flat wall in which there is provided a central hole through which the beverage can flow out.

Radial bridges protrude from the internal walls of the projection, proximate to its upper end, and support an internal island which is coaxial to the projection and whose dimensions conveniently match those of the hole formed in the upper closure and are such as to have no slack.

In this way, the aseptic closure is perfectly closed when the upper closure, which can slide along the projection, is lowered completely and the hole formed in the wall is closed hermetically by the island arranged inside the projection.

In order to make the beverage flow out from the container, it is instead sufficient to slide upward the upper closure, so as to release the internal island, disengaging it from the rims of the hole.

Once the user has lifted the upper closure, he can drink directly by bringing the closure to his mouth.

The main body of the closure is normally screwed onto the neck of the container, and as a guarantee of the integrity of the package it can be disengaged from the container only after separating it, by tearing, from a strip-ring of the per se known type, which is inserted so as to wrap around the neck of the container.

The upper closure is further provided with a cap-like closure element which covers it, so as to protect the region that is placed in the user's mouth.

The above-described closure effectively performs its task, but unfortunately suffers the drawback of making the sterilization step difficult.

According to statutory provisions, the beverage must in fact be stored in a fully sterilized environment and accordingly the inside of the closure must be sterilized beforehand, before it is screwed onto the neck of the container.

This sterilization is normally performed by spraying sanitizing liquid, but due to the presence of the radial bridges and of the internal disk which protrude monolithically from the upper end of the projection, the liquid is never able to reach all the internal points of the closure.

Up to now, this drawback has been dealt with by separating the liquid, which must be confined inside the container alone, from the closure, by providing on the opening of the neck a disk made of a paper-aluminum bonded material which acts as a diaphragm and is fixed, for example, along the rims by gluing.

In this manner, the liquid remains inside the container and cannot access the internal region of the closure, unless the paper-aluminum disk is removed after tearing the strip-ring and unscrewing the main body of the closure.

This operation is in any case awkward for the user.

Another type of conventional closure comprises a main body provided with a threaded ring, arranged to be associated with the neck of a container, from which a tubular projection protrudes which is coupled to an upper closure.

Proximate to the main body, radial bridges protrude from the internal wall of the projection and support an internal island so as to form, together with the island, axial channels for the passage of the liquid of the container.

The upper closure is tubular and forms, with its lower end, an annular flow control element which provides a seal between the outer wall of the island and the internal wall of the tubular projection.

While solving the above-cited sterilization problems (when the upper closure is lowered, the liquid passage channels are closed by the flow control element and the sanitizing liquid encounters the internal island, the radial bridges and the flow control element), the above-described closure has given rise to other problems linked to the double sealing wall, which does not always ensure a hermetic seal due to molding tolerances.

SUMMARY OF THE INVENTION

The aim of the present invention is to provide an aseptic closure for containers of liquids which solves all the above-described drawbacks.

An object of the present invention is to provide a closure which can be easily sterilized internally with sanitizing liquid according to per se known methods.

A further object of the present invention is to provide a closure for containers which allows repeated opening and closure.

A further object of the present invention is to provide an aseptic closure for containers which can be provided by means of a very simple structure.

Still a further object is to provide an aseptic closure which does not require the use of paper-aluminum disks.

A further object of the present invention is to provide a closure for containers which ensures good durability and strength over time, in accordance with the requirements of the user.

Still a further object is to provide an aseptic closure for containers which can give the user assurance, at the time of purchase, of the integrity of the container, so that it is certain that that package has never been opened before.

Still a further object of the present invention is to provide an aseptic closure for containers which can be manufactured at costs which can be compared to those of conventional closures.

This aim and these and other objects which will better become apparent hereinafter are achieved by an aseptic closure for containers of liquids according to the present invention, comprising a main body provided with a threaded ring, which is designed to be associated with a neck of a container and from which a tubular projection protrudes which is coupled to an upper closure, characterized in that a step protrudes from an inside wall of said projection, proximate to the main body, and forms a passage hole which is controlled by a flow control element which is monolithic, by means of radial supporting bridges, with respect to said upper closure, said upper closure having a tubular structure and being able to slide axially along said projection from a lowered position, which closes said hole because said flow control element forms a seal against said wall, to a raised position for opening said hole for the passage of the liquid.

BRIEF DESCRIPTION OF THE DRAWINGS

Further characteristics and advantages of the present invention will become better apparent from the following detailed description of a preferred embodiment thereof, illustrated only by way of non-limitative example in the accompanying drawings, wherein.

DESCRIPTION OF THE PREFERRED EMBODIMENTS

Figure 1:
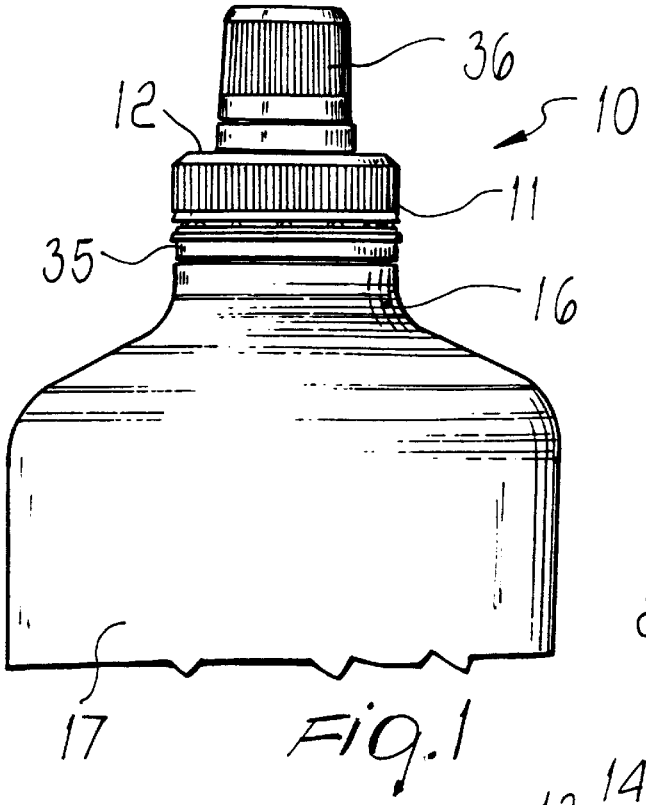
FIG. 1 is a side view of an aseptic closure for containers of liquids according to the present invention, in the operating configuration.
Figure 3:
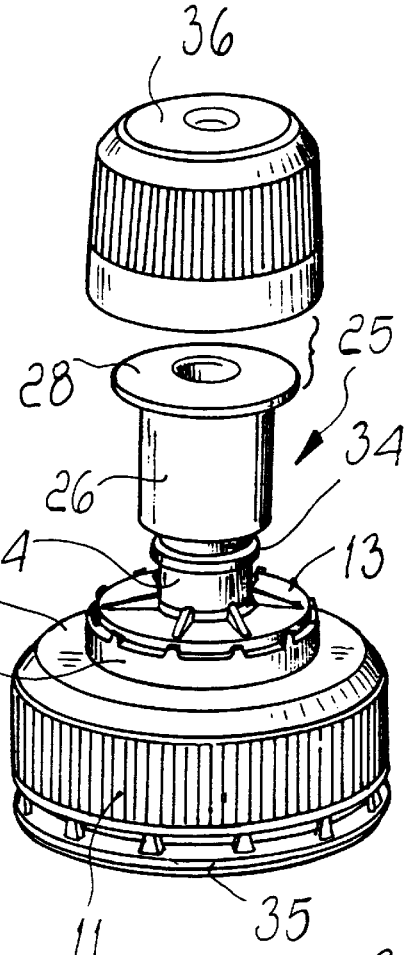
FIG. 3 is a perspective view of the closure of FIG. 1 in the open configuration.
Figure 2:
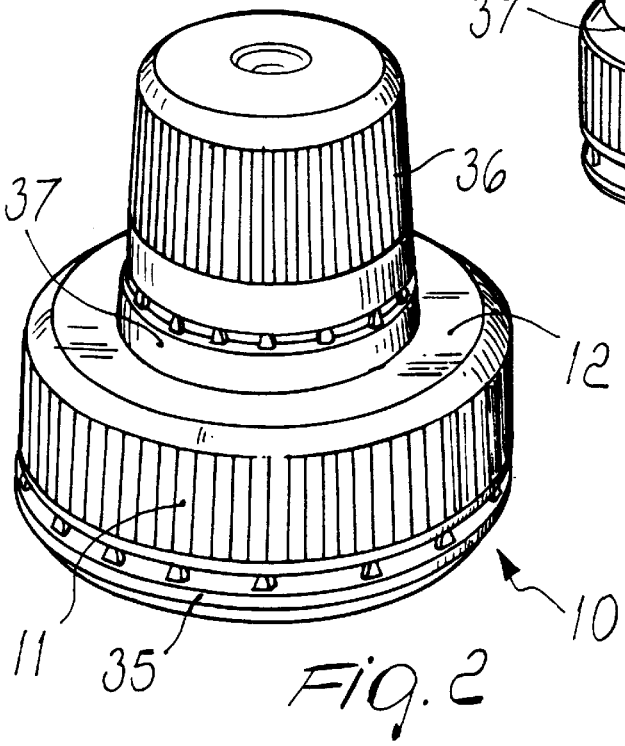
FIG. 2 is a perspective view of the aseptic closure of FIG. 1, in the closed configuration.
Figure 4:
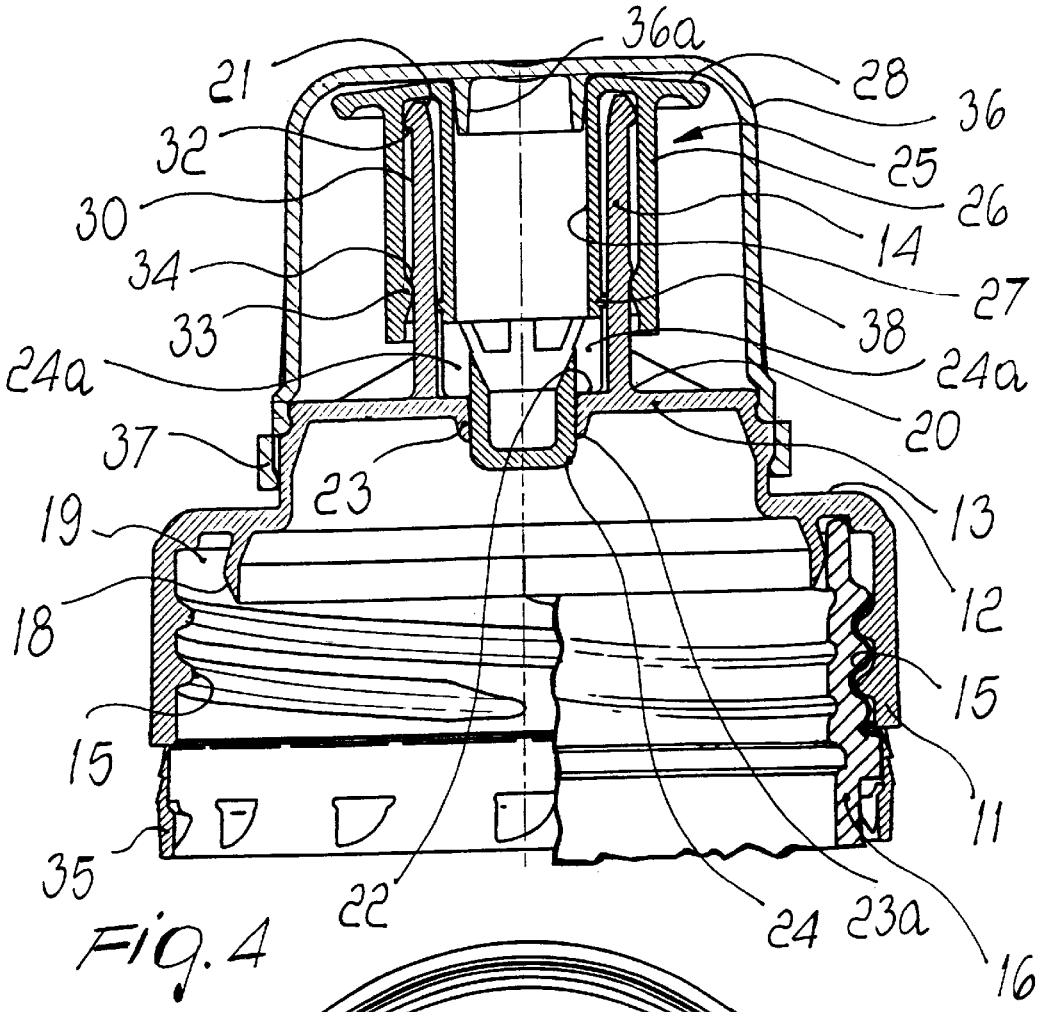
FIG. 4 is a sectional view, taken along a longitudinal plane, of the aseptic closure of FIG. 1 in the closed configuration.
Figure 5:
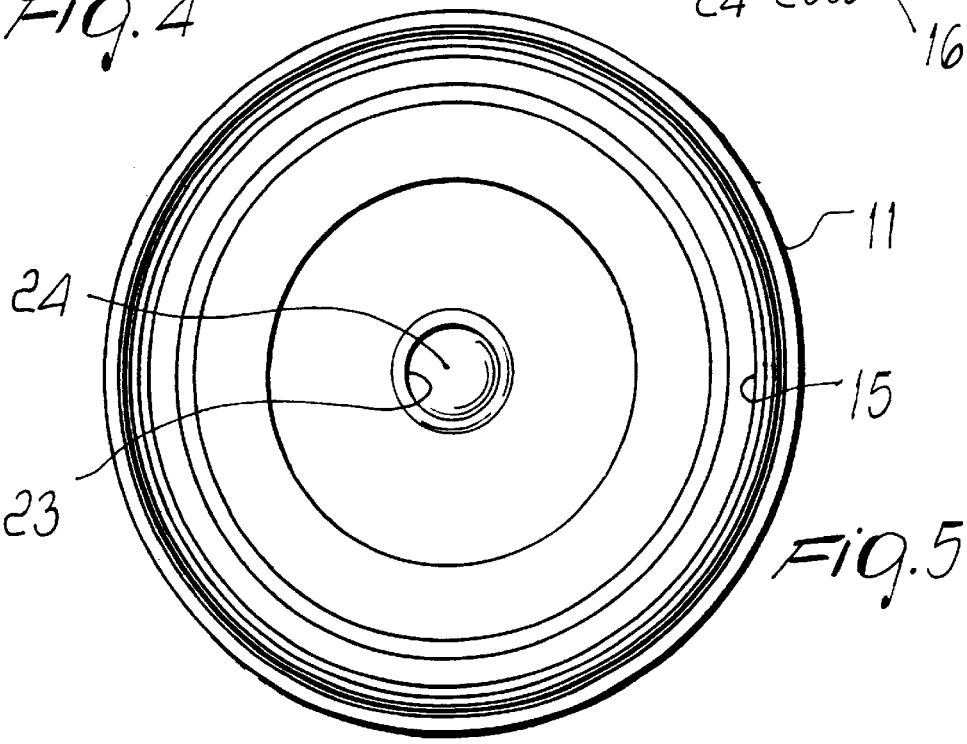
FIG. 5 is a bottom view of the aseptic closure of FIG. 4.
Figure 6:
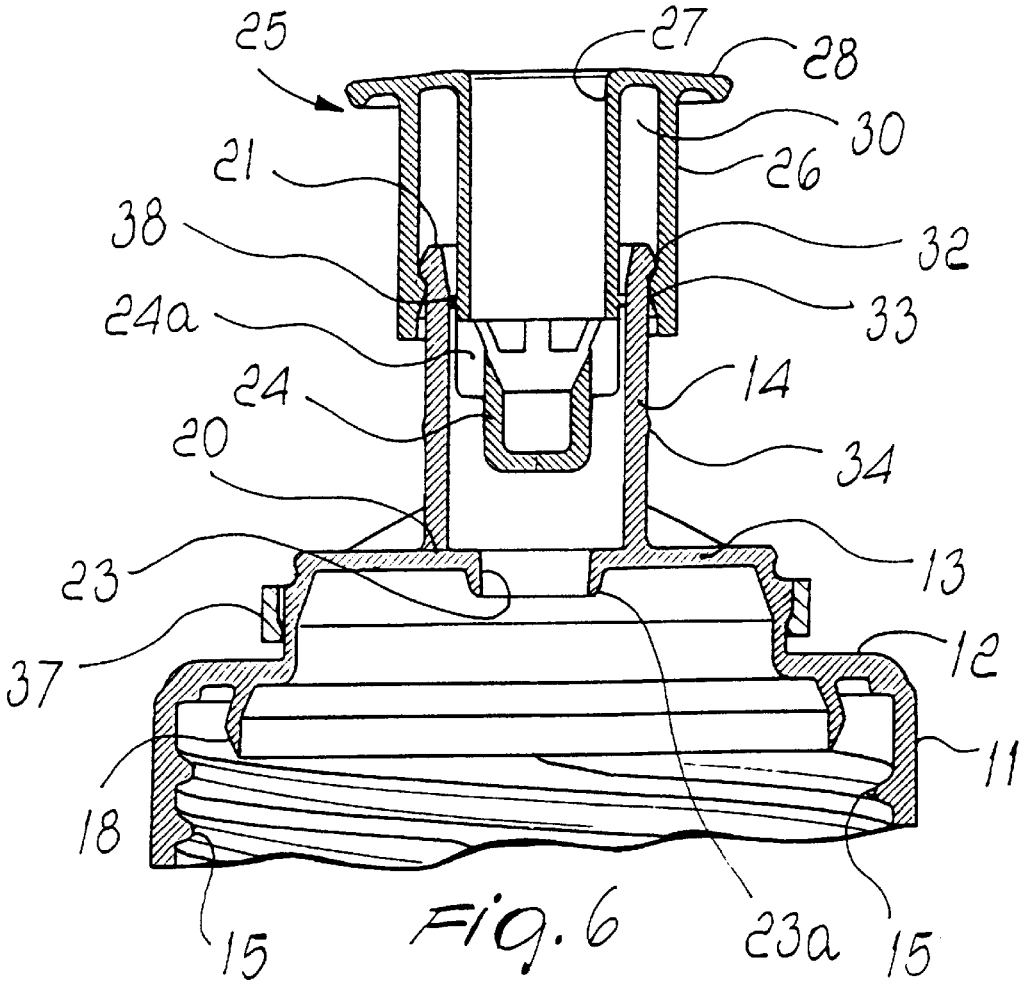
FIG. 6 is a sectional view, taken along a transverse plane, of the aseptic closure shown in FIG. 3 in the open configuration.
Figure 7:
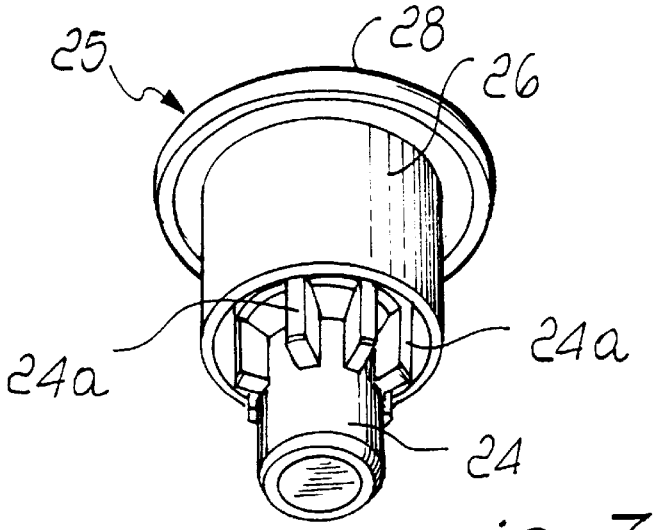
FIG. 7 is a bottom perspective view of a component of the aseptic closure.

With reference to the above figures, an aseptic closure for containers according to the present invention is generally designated by the reference numeral 10 and comprises a main body 11 provided with a threaded ring, from one end of which a first annular plane 12 and a second annular plane 13 protrude; the second annular plane is raised and coaxial to the first plane.

A tubular projection 14 protrudes monolithically from the second annular plane and is coaxial to the main body 11; its dimensions are conveniently smaller than those of the second plane 13.

A thread 15 is formed on the internal wall of the main body 11 for screwing against the neck 16 of a container 17, while a lip 18 protrudes internally from the first annular plane 12; the lip also has a cylindrical annular shape and forms, together with the remaining body 11, a seat 19 for accommodating the end rims of the neck 16.

A base region 20, contiguous to the main body 11, and an upper end 21 can be identified on the projection 14.

A step 22 protrudes from the inside wall of the projection at the base region 20 and delimits a passage hole 23 which is controlled by a cylindrical flow control element 24, which is monolithic with respect to an upper closure 25 by means of radial supporting bridges 24*a* which in any case leave liquid passage regions.

The wall of the hole 23 ends, in a downward region, with a lip 23*a* (which protrudes downward from the plane 13) which is elastically flexible and has a slightly narrower diameter than the rest of the hole 23 and than the flow control element 24.

The lid 23*a* therefore ensures the seal on the flow control element 24 by deforming elastically when the flow control element passes completely through the hole 23.

The closure 25 has a double-tube structure and comprises, in practice, a cylindrical wall 26 which lies outside the projection 14 and a wall 27 which is arranged inside it; both walls are monolithic with respect to an annular upper flange 28.

An annular guiding slot 30 is provided between walls 26 and 27; its dimensions are adapted to contain the projection 14 for the sliding of the upper closure 25 along the projection 14.

The flow control element 24 provides a closure seal against the wall of the hole 23, since it is conveniently shaped complementarily.

At the upper end 21 of the projection 14 there is provided a first annular stroke limiting raised portion 32 which protrudes outward.

A second annular raised portion 33 protrudes inward correspondingly from the wall 26 of the upper closure 25 so as to limit the annular guiding slot 30.

In this way, the upper closure 25 can slide along the projection 14, rising until the second raised portion 33 abuts against the first stroke limiting raised portion 32 and is locked by it so as to prevent its disengagement from the projection 14.

The locking, however, is not fixed, since the upper closure 25 can be removed by forcing it appropriately.

A third annular raised portion 34 protrudes outward at an intermediate portion from the wall of the projection 14 so as to limit the guiding slot 30; the third annular raised portion is smaller than the first annular raised portion 32 and the second annular raised portion 33 and constitutes a stop element for the closure and opening of the hole 23.

When the aseptic closure 10 is closed, the upper closure 25 is in fact lowered and the flow control element 24 closes the hole 23, forming the appropriate seal with the internal wall thereof.

In order to open the closure 10, it is necessary to lift the upper closure 25, making it slide along the projection 14, whose wall is accommodated in the annular guiding slot 30, after making the second raised portion 33 move beyond the third raised retention portion 34.

Likewise, in order to re-close the closure 10 it is necessary to lower the upper closure 25, making the second raised portion 33 move beyond the third raised retention portion 34, so that the flow control element 24 closes the hole 23.

An annular raised portion 38 protrudes outward at the lower part of the wall 27 and forms a seal against the inside wall of the projection 14, so that when the upper closure 25 is raised and the liquid is poured none of the liquid can enter the slot 30 and therefore flow out under the wall 26.

The main body 11 is fixed to a first strip-ring 35, which is conveniently inserted so as to wrap around the neck 16 of the container 17, so that it guarantees the integrity of the container 17.

Finally, the closure 10 is completed by a cap-shaped covering element which is adapted to cover the upper closure 25 and whose rims rest at the outer profile of the second annular plane 13 of the main body 11.

The covering element 36 has a cylindrical axial internal projection 36*a* which enters the wall 27.

The covering element 36 also is fixed to a second strip-ring 37, which is associated so as to wrap around the raised portion of the second annular plane 13 of the main body 11.

The second strip-ring 37 gives the user of the container 17 assurance of the integrity of the container, since the upper closure 25 cannot be lifted without tearing the covering element 36 away from the second strip-ring 37.

Thanks to the structure of the aseptic closure 10, sterilization can be performed very simply.

When the upper closure 25 is lowered, the hole 23 is in fact closed by the flow control element 24 and the sanitizing liquid sprayed inside the closure 10 encounters, at the base region 20 of the projection 14, a substantially flat surface constituted by the flow control element 24 and by the annular plane 13.

As regards the closure seal, it is provided on a single surface; this allows to provide a hermetic closure, ensured by the lip 23*a*.

In practice it has been observed that the present invention widely achieves the intended aim and objects.

In particular, an important advantage is achieved with the present invention in that an aseptic closure for containers of liquids has been provided which allows repeated closures and re-openings and a sterilization process according to conventional methods and with conventional equipment.

Another advantage is achieved with the present invention in that an aseptic closure has been provided which has a simple and reliable structure.

Another advantage has been achieved in that an aseptic closure has been provided which can be manufactured at costs which are comparable to those of conventional closures.

The present invention is susceptible of numerous modifications and variations, all of which are within the scope of the same inventive concept.

Moreover, the materials employed, so long as they are compatible with the contingent use, as well as the dimensions, may be any according to requirements.

All the details may be replaced with other technically equivalent elements.

The disclosures in Italian Patent Application No. PD99A000142 from which this application claims priority are incorporated herein by reference.

What is claimed is:

1. An aseptic closure for containers of liquids, comprising a main body provided with a threaded ring, which is arranged to be associated with a neck of a container and from which a tubular projection protrudes which is coupled to an upper closure, wherein a step protrudes from an inside wall of said projection, proximate to the main body, and forms a passage hole which is controlled by a flow control element which is monolithic, by means of radial supporting bridges, with respect to said upper closure, said upper closure having a tubular structure and being able to slide axially along said projection from a lowered position, which closes said hole because said flow control element forms a seal against its wall, to a raised position for opening said hole for the passage of the liquid.

2. The aseptic closure according to claim 1, wherein said flow control element has a cylindrical structure at least at a portion to be inserted in said hole.

3. The aseptic closure according to claim 1, wherein the wall of said passage hole ends, in a downward region, with a flexible lip which has a slightly smaller diameter than said flow control element.

4. The aseptic closure according to claim 1, wherein said upper closure is shaped like a double tube, which comprises a cylindrical wall which lies outside said projection and said wall which is monolithic with respect to said flow control element and is internal to said projection, said projections being monolithic with respect to an annular upper flange.

5. The aseptic closure according to claim 4, wherein a first annular raised stroke limiting portion protrudes outward at an upper end from said tubular projection, and a second annular raised portion protrudes inward from the external cylindrical wall of said closure at an intermediate portion, said closure being able to slide along said projection so as to be lifted until said second annular raised portion abuts against said first one, so as to prevent its disengagement.

6. The aseptic closure according to claim 5, wherein a third annular raised portion protrudes outward from said tubular projection at an intermediate portion in order to retain said second raised portion when said upper closure is completely lowered.

7. The aseptic closure according to claim 4, wherein an annular raised portion for forming a seal against the inside wall of said projection protrudes outward at a lower part of the internal wall which is monolithic with respect to said flow control element.

8. The aseptic closure according to claim 1, wherein said main body is fixed, at its free end, to a strip-ring which is inserted so as to wrap around the neck of said container in order to ensure the integrity of the container.

9. The aseptic closure according to claim 1, wherein said tubular projection is provided with a cap-shaped covering element whose rims abut, during closure, against an annular plane which is monolithic to said main body.

10. The aseptic closure according to claim 9, wherein said covering element is fixed to a strip ring which is inserted so as to laterally wrap around a portion of said main body so as to ensure the integrity of said closure.

11. The aseptic closure according to claim 9, wherein said covering element has an axial cylindrical internal projection which enters the internal wall of said upper closure, against which it forms a seal.

* * * * *